US005351860A

United States Patent [19]

Gotoh

[11] Patent Number: 5,351,860

[45] Date of Patent: Oct. 4, 1994

[54] COUPLING FOR BREAKING A SEAL FILM OF A DISPENSING OPENING FOR A FLUID-FILLED CONTAINER

[75] Inventor: Kunihiko Gotoh, Tokyo, Japan

[73] Assignee: Nitto Kohki Co., Ltd., Tokyo, Japan

[21] Appl. No.: 996,588

[22] Filed: Dec. 24, 1992

[51] Int. Cl.[5] ..... B67D 5/00

[52] U.S. Cl. ..... 222/83; 222/82; 222/89

[58] Field of Search ..... 222/81, 82, 83, 83.5, 222/88, 89, 541, 105

[56] References Cited

U.S. PATENT DOCUMENTS

| | | | |
|---|---|---|---|
| 2,849,156 | 8/1958 | Mansted | 141/330 |
| 3,779,082 | 12/1973 | Galloway | 141/330 UX R |
| 4,436,125 | 3/1984 | Blenkush | 141/330 |
| 4,445,550 | 5/1984 | Davis et al. | 141/329 |
| 4,614,437 | 9/1986 | Buehler | 141/329 X |
| 4,765,511 | 8/1988 | Clements | 222/83 |
| 4,919,174 | 4/1990 | Warland | 141/384 |
| 4,941,517 | 7/1990 | Galloway | 141/1 |
| 4,948,014 | 8/1990 | Rutter et al. | 222/105 X |
| 4,969,491 | 11/1990 | Kiplinger | 141/1 |
| 5,102,010 | 4/1992 | Osgar et al. | 222/82 X |
| 5,205,440 | 4/1993 | Matsushita | 222/83 |

FOREIGN PATENT DOCUMENTS

| | | | |
|---|---|---|---|
| 58-125787 | 8/1983 | Japan . | |
| 62-258288 | 11/1987 | Japan | 222/83 |
| 0118797 | 5/1990 | Japan | 222/83 |
| 2077243 | 12/1981 | United Kingdom | 222/81 |
| 2165531 | 4/1986 | United Kingdom | 222/81 |

*Primary Examiner*—Kevin P. Shaver
*Attorney, Agent, or Firm*—Nixon & Vanderhye

[57] ABSTRACT

A coupling comprises a plug attached to the opening of a fluid-filled container. The plug includes an inner cylinder having an opening sealed by film comparatively easily broken by a sharp tip or a blade, and an outer cylinder fitted onto the inner cylinder. A socket is connected to the plug, the socket including a connection to a fluid suction pump. A cutter section has a tip portion shaped like a triangular pyramid to gradually break the film at the opening of the inner plug cylinder when the socket is connected to the plug and also has a trunk portion continuous from the tip portion and shaped like a triangle pole. An inner cylinder is carried by the socket and has a valve synchronous with the sucking operation of said fluid suction pump to open and close a fluid passage in the inner cylinder. A sleeve having a collar rotatably fitted on the inner cylinder and cooperative with a stopper on the outer plug cylinder serves to detachably fix the inner socket cylinder in the plug.

6 Claims, 2 Drawing Sheets

COUPLING FOR BREAKING A SEAL FILM OF A DISPENSING OPENING FOR A FLUID-FILLED CONTAINER

BACKGROUND OF THE INVENTION

1. Field of the Invention

The present invention relates to a coupling for connecting a container to means for sucking fluid filled in the container, while breaking thin sealing film attached to the opening of the container.

2. Description of the Related Art

There have been well-known automatic vending machines of the bag-in-box type (which will be hereinafter referred to as BIB type) wherein plastic-made flexible containers filled with drinks such as coffee and juice and transported in boxes made by corrugated cardboard are set in the automatic vending machines.

According to the automatic vending machines of the BIB type, it is not needed to collect those containers which have become vacant after fluid drinks therein are drunk up. This is quite excellent in that the running cost of the automatic vending machines can be reduced and also sanitary in that fluid in the container can be sucked by a pump without exposing the fluid to the air.

Japanese Patent Disclosure Sho 62-258288 discloses a coupling for connecting a container housed in the automatic vending machine to means for sucking fluid filled in it.

The coupling disclosed in this reference comprises a female connector attached to the container and a male connector fitted into the female connector. When the male connector is fitted into the female one, thin film bonded to the female connector is broken with a tip portion at the front end of the male connector and the container is thus opened. When the male connector is further pushed into the female one under this state, a valve in an inner cylinder of the male connector is opened to communicate the container with a fluid passage in the male connector. When the male connector is pulled out of the female one, the valve in the male connector is closed to shield the inside of the piping in the male connector from outside air and prevent fluid left in the piping from coming out of it.

Japanese Utility Model Disclosure Hei 3-69392 also discloses a coupling wherein a valve in the coupling is opened and closed associating with the operation of a suction pump connected to the coupling to shield fluid in the container from the air so as to increase the sealing capacity of the container.

In the case of the couplings disclosed in the above-mentioned references, however, the connecting of these couplings could not be made smooth because of the connecting resistance of the male connector (or plug) relative to the female connector (or socket) and the sliding resistance of seal rings used, and because the pressing force of the male connector applied to the thin film to break it was larger than expected.

The inventor of the present invention repeated tests of breaking aluminium foil with the conventional socket which included a cutter section in the socket comprising a tip potion shaped like a cone and a trunk portion continuous from the tip portion shaped like a cylindrical pole. As the result, it has been found that the aluminium foil is broken not from its area on which the tip potion of the cutter section abuts but substantially from its center in three directions, that load applied to push and spread the aluminium foil with the cylindrical trunk portion of the cutter section is larger than load needed to break the aluminium foil by the tip portion of the cutter section at the initial stage, and that the aluminium foil is liable to be peeled off from the opening of the female connector and its pieces thus peeled off are mixed into the fluid in the container because it is pushed and spread at its area adjacent to the opening rim of the female connector by the cylindrical trunk portion of the cutter section.

SUMMARY OF THE INVENTION

The object of the present invention is therefore to provide a coupling capable of more smoothly breaking the thin film, which serves to seal the container, without peeling it from the opening rim of the plug and also capable of more easily communicating the container with means for sucking fluid filled in the container.

This object can be attained by a detachable coupling comprising a plug attached to an opening of the container and a socket provided with a cutter section to break thin film which closes the opening of the container when the coupling is applied, wherein a tip portion of the cutter section is shaped like a triangular pyramid while a trunk portion thereof continuous from the tip portion is shaped like a triangle pole and a fluid passage through which fluid in the container flows is formed in the cutter section.

When the socket is pushed into the plug, the tip portion of the cutter section of the socket abuts on the thin sealing film attached to an opening of the plug. The breaking of the thin film is thus started at first from the vicinity of its center in two directions.

When the socket is further pushed into the plug, the breaking of the thin film is advanced by the tip portion of the cutter section while a further breaking of the thin film is started in a new direction. In short, the thin film is broken in three radial directions to have an equal area between two adjacent breaking lines.

When the socket is still further pushed, the trunk portion of the cutter section pushes and spreads only the broken areas of the thin film along the side walls of its triangle pole.

The thin film is broken and spread in this manner with the tip and trunk potions of the cutter section to open the fluid passage.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
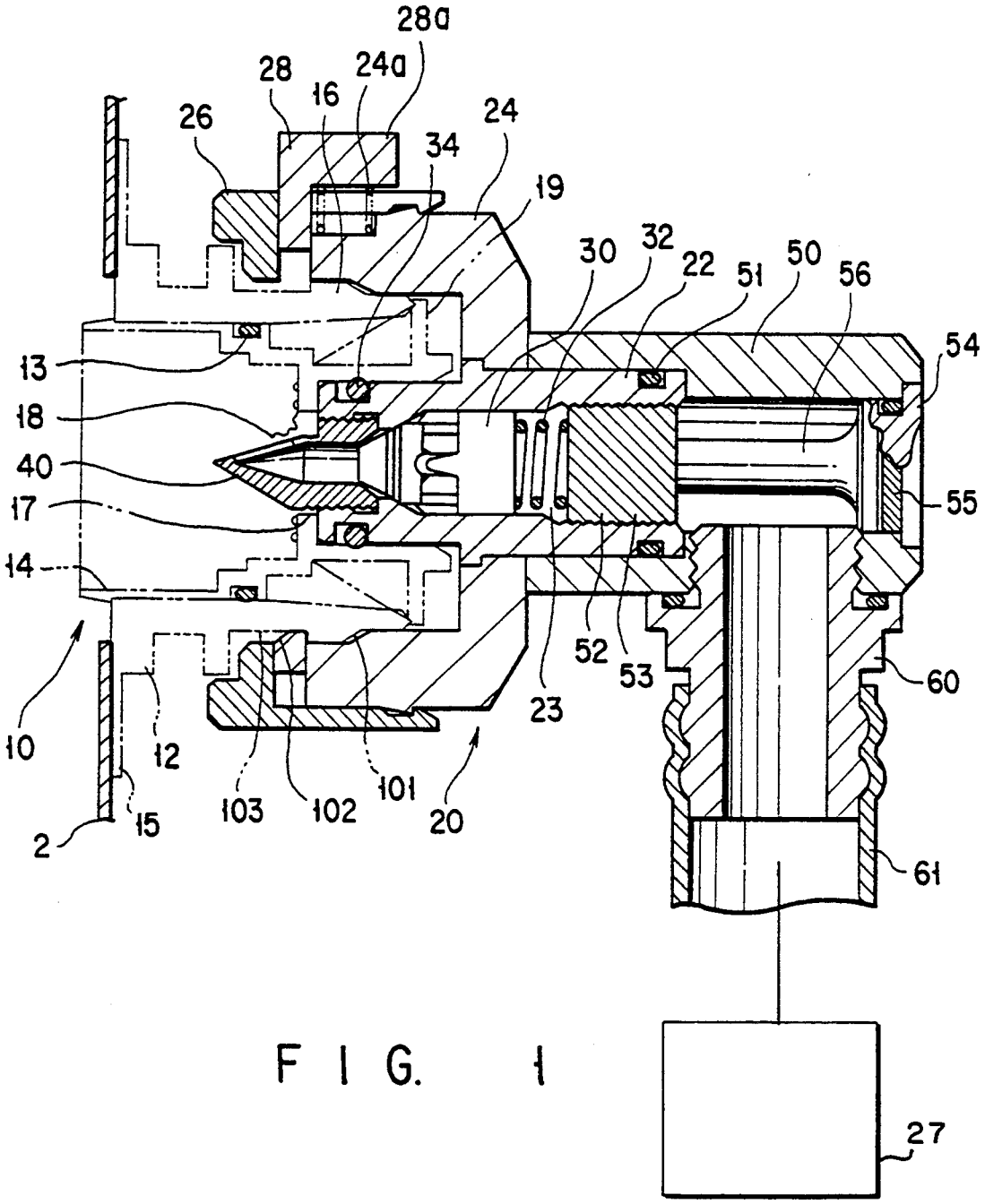
FIG. 1 is a vertically-sectioned side view showing a coupling of the present invention connected.

FIG. 1 is a vertically-sectioned side view showing a coupling of the present invention connected. This coupling comprises a socket 20 having a valve 30 therein, and a plug 10.

The plug 10 shown by two-dot lines comprises an outer cylinder 12 and an inner cylinder 14 which is fitted into the outer cylinder 12 through an O-ring 13. A collar 15 is formed round that end opening of the outer cylinder 12 which is faced a fluid container 2, and it is air-tightly fixed to an opening of the fluid container 2.

A swelled ring 16 is formed round that front end portion of the outer cylinder 12 which is faced a socket 20. A collar flange 19 is formed round that front open end portion of the inner cylinder 14 which is faced the socket 20 to hold the outer cylinder 12 not moved.

An opening 17 having a certain diameter is provided in the inner cylinder 14 at the center thereof when viewed in the axial direction of the plug 10, and it is closed by a thin film 18 comparatively easily broken with a sharp tip of the blade. Aluminium foil is often used as the thin film 18 from the view-point of safety and sanitation.

The plug 10 arranged as described above is closely attached to the opening of the fluid container 2 and fluid such as soft drink filled in the container 2 can be well shielded from air outside by the thin film 18 such as aluminium foil.

The socket 20 shown by solid lines houses a valve 30 in that front end portion thereof which is faced the inner cylinder 14 of the plug 10. It comprises mainly an inner cylinder 22 fitted into the inner plug cylinder 14, a sleeve 24 freely rotatably fitted on the inner socket cylinder 22 and pushed onto the outer plug cylinder 12 when the socket 20 is pushed into the plug 10, and a lock ring 28 sandwiched between the sleeve 24 and a cover 26, which is freely detachably capped to the front open end of the sleeve 24, so as to slide in a direction perpendicular to the axial direction of the inner socket cylinder 22.

The valve 30 is urged by a compression coil spring 32 in a direction, in which the socket 20 is connected to the plug 10. When the coupling is in its waiting position shown in FIG. 1 while keeping the socket 20 pushed into the plug 10, the valve 30 is urged in the connecting direction of the socket 20 by the spring 32 to close the fluid passage 23 in the inner socket cylinder 22, but when a suction pump 27 is driven, it is retreated against the spring 32 by the sucking force of the pump to open the fluid passage 23. The fluid filled in the container 2 can be thus sucked from the container 2 into the fluid passage 23.

An O-ring 34 is fitted round the front end of the inner socket cylinder 22 to conduct sealing between the inner socket and plug cylinders 22 and 14 when the inner socket cylinder 22 is fitted into the inner plug one 14.

Figure 2A:
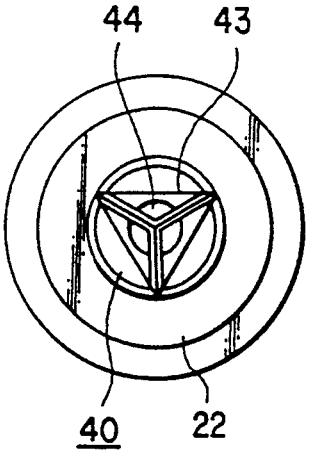
FIG. 2A is a front view showing a cutter section and an inner cylinder of the socket enlarged.
Figure 2B:
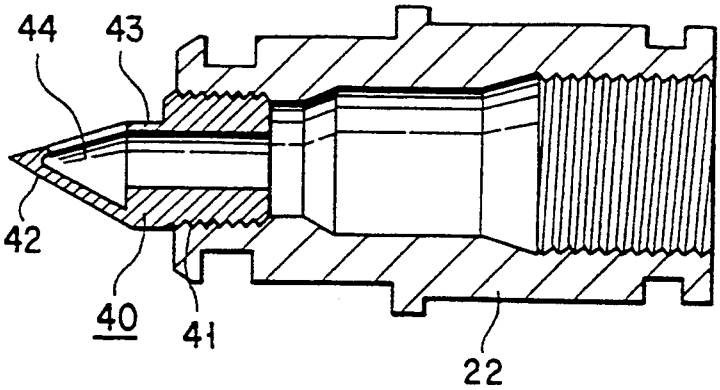
FIG. 2B is a side view showing the same.

As shown on an enlarged scale in FIG. 2B, a cutter section 40 is attached to that front end of the inner socket cylinder 22 by screwing its male screw 41 into this front end of the inner socket cylinder 22, which is pushed into the inner plug cylinder 14. The cutter section 40 shown in FIGS. 2A and 2B includes a tip portion 42 shaped like a triangular pyramid, a trunk portion 43 continuous from the tip portion 42 shaped like a triangle pole, and a passage 44 extending therein in the axial direction thereof.

Tests of breaking the aluminium foil on the opening of the plug 10 by that cutter section of the well-known socket, which had the cone-shaped tip portion and the cylindrical trunk portion continuous from the tip portion, were conducted and the following results were obtained.

1) As the tip portion of the cutter section was pushed against the aluminium foil, the breaking of the aluminium foil was started not from that portion of the foil on which the tip portion of the cutter section abuts but from the vicinity of the center thereof and in two directions in the radial direction thereof. The load applied this time was about 0.6 Kgf.

2) When the tip portion of the cutter section was further pushed against the foil, the breaking of the foil was advanced and when the load reached about 1.4–1.6 Kgf, another one-way breaking of the foil was started from the vicinity of the foil center. In short, the aluminium foil never failed to be broken in three directions to have a substantially equal area between two adjacent breaking lines.

3) When the tip portion of the cutter section was still further pushed against the foil after the foil was broken in three directions, the foil was further broken and spread along the outer cylindrical circumference of the trunk portion of the cutter section and the load applied this time became so large, ranging from 3.0 Kgf to 3.5 Kgf. This reason is imagined that the cutter section needs large force for pushing and spreading that area of the foil which is adjacent to the foil-bonded opening rim of the plug by the outer cylindrical circumference of the trunk portion thereof even if the foil is broken at first with the cone-shaped tip portion thereof.

Figure 4:
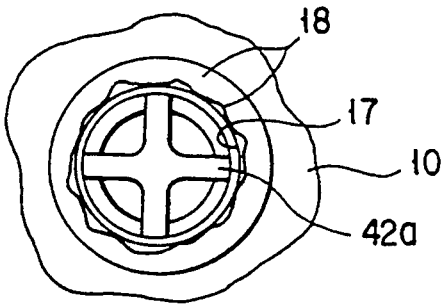
FIG. 4 is an enlarged front view showing the thin film broken by the cutter section of the conventional socket.

FIG. 4 is an enlarged front view showing the aluminium foil 18 broken. The aluminium foil 18 is push-broken and spread like a circle in this case. Reference numeral 42*a* represents the tip portion of the cutter section which is shaped like a cone.

4) The aluminium foil is push-broken and spread to that area thereof which is adjacent to the opening rim of the plug 10 when it is spread like a circle. It has been therefore found that the aluminium foil is peeled off from the opening rim of the plug into the drink fluid in the fluid container.

5) The inventor of the present invention therefore conducted same tests using the same aluminium foil but using a socket having a cutter section with a tip portion shaped like a triangular pyramid and a trunk portion shaped like a triangle pole. The broken shape of the foil and the load applied at the initial stage were same as in the above case 1), but the load added to further push-break and spread the foil was sharply reduced to 0.4–0.7 Kgf.

This is because only the three equal areas of the foil broken are spread outside, like triangles, along the walls of the triangle-pole-shaped trunk portion of the cutter section. Therefore, no pressing force is applied to that area of the foil which is adjacent to the opening rim of the plug, thereby leaving this area of the foil not peeled from the opening rim of the plug.

Figure 3:
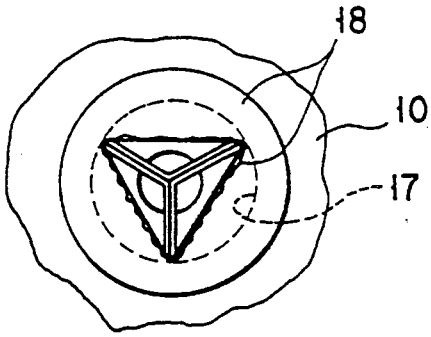
FIG. 3 is an enlarged front view showing the thin film, which serves to close an opening of the fluid container, broken by the cutter section of the socket.

FIG. 3 is an enlarged front view showing the aluminium foil 18 broken with the cutter section 40.

Taking the above test results into consideration, the cutter section 40 of the present invention is arranged to have the tip portion 42 shaped like a triangular pyramid and the trunk portion 43 continuous from the tip portion 42 shaped like a triangle pole having three equal sides when viewed in section.

On the other hand, that end of the socket 20 which is in opposite to the plug-connected end thereof comprises an adapter 60 screwed, perpendicular to the axial line of the socket 20, into the outer circumference of the socket 20; an outer cylinder 50 of the socket 20 fitted onto that end of the inner socket cylinder 22, which is in opposite to the plug-connected end thereof, through an O-ring 51; and a cap 56 provided with a front portion 53 having a lengthwise hollow 52 through which the fluid is passed, said front portion being screwed into that end of the inner socket cylinder 22 which is in opposite to the plug-connected end thereof, and also provided with a rear portion 54 fitted from behind into the outer socket cylinder 50 through O-ring 55.

A tube 61 connected to the adapter 60 is communicated with the suction pump (not shown).

when the socket 20 is to be connected onto the plug 10, the inner socket cylinder 22 is pushed into the inner plug cylinder 14 to break, by means of the cutter section 40 of the inner socket cylinder 22, the thin film 18 by which the opening 17 of the inner plug cylinder 14 is sealed. As already described on the above tests, the thin film 18 is broken with the tip portion 42 of the cutter section 40 and then spread by the trunk portion 43 thereof. The fluid container 2 is thus communicated with the passage 44 in the cutter section 40 and then with the fluid passage 23 in the socket 20.

At the same time, a tapered portion 101 of the plug 10 abuts on a tapered portion 102 of the socket 20 which is formed at a part of the front bottom corner of the lock ring 28. When the socket 20 is further pushed onto the plug 10, the lock ring 28 is pushed downwards against compression coil spring 24*a*. When the socket 20 is still further forwarded and the tapered portion 102 of the rock ring 28 comes below a circumferential groove 103 on the outer plug cylinder 12, the lock ring 28 is pushed upwards by the coil spring 24*a* to seat its tapered portion 102 in the circumferential groove 103. The connecting of the socket 20 into the plug 10 can be thus finished.

According to the coupling of the present invention, the tip portion of the cutter section is shaped like a triangular pyramid and the trunk portion thereof like a triangle pole. Therefore, the thin film for sealing the opening of the inner plug cylinder can be prevented from peeling off from the opening rim of the inner plug cylinder. In addition, it can be more smoothly broken to more easily connect the fluid container to the suction means. The connecting of the coupling can be thus finished for a shorter time not to make the sealing of the fluid container loose. The coupling of the present invention is therefore extremely useful for pipe wirings in the automatic vending machines of the BIB type.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A coupling comprising:

a plug attached to an opening of a fluid-filled container, said plug including an inner cylinder having an opening sealed by a breakable film and an outer cylinder fitted on the inner cylinder; and a socket connected to the plug and including means connected to a fluid suction pump, a cutter section having a sharp blade tip including a tip portion having a triangular pyramidal shape to gradually break the film at the opening of the inner plug cylinder when the socket is connected to the plug, said blade tip also having a base portion continuous from the tip portion and having a triangular cross-sectional shape, an inner cylinder having a valve operable in synchronism with said suction pump to open and close a fluid passage formed in the inner cylinder, a sleeve having means rotatable fitted on the inner cylinder and cooperative with stopper means on the outer plug cylinder, when said cutter section finishes breaking the film, to detachably fix the inner socket cylinder in the plug when said cutter section finishes breaking the film, and an outer cylinder fitted on the inner socket cylinder.

2. The coupling according to claim 1, wherein said film is formed of metal foil.

3. The coupling according to claim 1, wherein said means rotatably fitted on the inner socket cylinder and cooperative with said stopper means on the outer plug cylinder, when said cutter section finishes breaking the film, to detachably fix the inner socket cylinder in the plug includes a lock ring provided with a push part, and a swelled ring on the outer plug cylinder.

4. The coupling according to claim 1, wherein said means connected to this fluid suction means includes an adapter attached to the outer socket cylinder and a tube connected to the adapter.

5. The coupling according to claim 1 wherein said triangular-shaped tip portion has side walls and openings through each side wall, said triangular-shaped base portion having a central passage in communication with said side wall openings of said tip portion.

6. A dispensing coupling for a container comprising a female connector having an opening closed by a seal, and attached to the container;

a male connector having a main cylindrical body portion, said main cylindrical body portion provided with a tip portion, said main cylindrical body portion and said tip portion adapted to be inserted into said opening to break said seal, said tip portion having a triangular pyramidal shape with side walls and openings through said side walls, said tip portion further including a base portion continuous from said tip portion and having a triangular cross-sectional shape and a passage therethrough in communication with said side wall openings;

a valve seat formed in said main cylindrical body portion;

a valve body arranged in a fluid passing path in said main cylindrical body portion and movable relative to said main cylindrical body portion and said tip portion, said valve body in fluid communication with said opening;

a spring for urging said valve body toward said opening and said valve seat to thereby maintain said valve body engaged with said valve seat upon insertion of said male connector into said female connector; and wherein when a suction pump is made operative to suck fluid from the container, said valve body is drawn toward and against said spring to disengage the valve body from the valve seat and thereby communicate said fluid passing path with the container through said passage, said side wall openings and said opening;

a sleeve rotatably fitted onto the outer circumference of said main cylindrical body portion of said male connector; and a lock ring arranged perpendicular to the longitudinal direction of said male connector and provided with a projection on its inner face to engage said female connector.

* * * * *